US007971944B2

(12) United States Patent
Sagel et al.

(10) Patent No.: US 7,971,944 B2
(45) Date of Patent: Jul. 5, 2011

(54) MOUNTING FOR AN EXTENSION PIECE OF A TALL CABINET

(75) Inventors: Thomas Sagel, Brakel (DE); Claus Sagel, Bielefeld (DE)

(73) Assignee: Vauth-Sagel Holding GmbH & Co. KG, Brakel (DE)

( * ) Notice: Subject to any disclaimer, the term of this patent is extended or adjusted under 35 U.S.C. 154(b) by 823 days.

(21) Appl. No.: 10/534,716

(22) PCT Filed: Nov. 12, 2003

(86) PCT No.: PCT/EP03/12645

§ 371 (c)(1),
(2), (4) Date: Nov. 15, 2005

(87) PCT Pub. No.: WO2004/043206

PCT Pub. Date: May 27, 2004

(65) Prior Publication Data

US 2006/0119238 A1 Jun. 8, 2006

(30) Foreign Application Priority Data

Nov. 13, 2002 (DE) ..... 202 17 511 U
Feb. 21, 2003 (DE) ..... 203 02 823 U

(51) Int. Cl.
*A47B 88/00* (2006.01)

(52) U.S. Cl. ..... 312/334.25; 312/270.3

(58) Field of Classification Search ..... 312/223.1, 312/265.4, 334.24, 334.23, 333, 334.44, 312/270.3, 332.1, 334.46; 292/121, 163, 292/174, 175, 176, 219, 240, 302, 60, DIG. 61; 16/245, 246

See application file for complete search history.

(56) References Cited

U.S. PATENT DOCUMENTS

| | | | | |
|---|---|---|---|---|
| 2,546,149 | A * | 3/1951 | Bowzer | 16/110.1 |
| 3,837,721 | A * | 9/1974 | Manlove et al. | 312/265.5 |
| 4,142,272 | A * | 3/1979 | Oogami et al. | 16/245 |
| 4,230,001 | A * | 10/1980 | Noll et al. | 81/9.22 |
| 4,370,773 | A * | 2/1983 | Hadary | 15/172 |
| 4,746,152 | A * | 5/1988 | Willcox | 292/150 |
| 4,860,903 | A * | 8/1989 | Jennings et al. | 211/4 |
| 5,379,487 | A * | 1/1995 | Bowers | 16/240 |
| 5,617,642 | A * | 4/1997 | Marios | 33/526 |
| 5,951,132 | A * | 9/1999 | Cirocco | 312/334.46 |
| 6,199,966 | B1 * | 3/2001 | Fulterer | 312/334.24 |
| 6,364,377 | B1 * | 4/2002 | Ferguson | 292/175 |
| 6,390,574 | B2 * | 5/2002 | Fraccaro | 312/333 |
| 2002/0033658 | A1 * | 3/2002 | Salice | 312/334.14 |
| 2002/0153816 | A1 * | 10/2002 | Banicevic et al. | 312/404 |

FOREIGN PATENT DOCUMENTS

| | | |
|---|---|---|
| DE | 299 06 227 U1 | 8/1999 |
| DE | 102 13 640 A | 10/2002 |

* cited by examiner

*Primary Examiner* — Darnell M Jayne
*Assistant Examiner* — Matthew W Ing
(74) *Attorney, Agent, or Firm* — Laurence A. Greenberg; Werner H. Stemer; Ralph E. Locher

(57) ABSTRACT

A mounting for an extension piece of a tall cabinet comprising a front furniture piece (5) which is attached to a vertical, central, strong frame (1). The height of the frame (1) is adjusted on the lower telescopic rail (2) by means of two height-adjustable screws (4) and is locked by means of a locking bolt (11) which is elastically guided in a horizontal manner in the lower frame segment (10).

12 Claims, 4 Drawing Sheets

MOUNTING FOR AN EXTENSION PIECE OF A TALL CABINET

The invention relates to mounting hardware for a tall-cabinet pullout having a furniture front attached on a vertical central rigid frame, said frame being affixed to an upper and on a lower telescopic rail in such a way that it can be pulled out from the tall cabinet.

PRIOR ART

In a tall-cabinet pullout, also referred to as pharmacy-style pullout or pantry pullout, a central rigid frame supports the baskets or shelves inside the cabinet. Tall-cabinet pullouts of this type with telescopic rails are known, for example, from German utility-model DE 299 06 227.6.

In these cabinets, the frame is attached at the top and bottom in each case to a telescopic rail, and the cabinet pullout is pulled into or out from the carcass of the cabinet in this manner. The furniture front of the pullout is attached to the frame and adjustable in such a way that a smooth transition to and flush lines with the adjacent furniture fronts are created. To adjust the furniture fronts, various types of mounting hardware are known, which are expensive to produce, however, and very labor-intensive in their assembly. A tall cabinet of this type is usually very narrow. This impedes the mounting of the frame to the telescopic pullouts and the adjustment of the furniture front.

OBJECT AND SUMMARY OF THE INVENTION

It is the object of the invention to provide mounting hardware for a tall-cabinet pullout whereby the pullout can be very easily mounted to a lower and to an upper telescopic rail and which allows for an easy adjustment of the furniture front.

This object is met in such a way that the frame is adjusted with respect to its height on the lower telescopic rail by means of two spaced-apart height adjustment screws, and maintained in a locked postion by means of a locking latch, which is spring biased in the locked position in the lower frame segment, and that the upper telescopic rail has disposed on it two bolts to which the frame is attached by means of a snap lock and a guide block for lateral guiding.

The welded rigid frame forms the supporting structure of the tall-cabinet pullout. It is supported at the bottom on a telescopic rail that is screwed into the carcass of the cabinet. Screwed into the lower telescopic rail are two height adjustment screws onto which the frame is placed. Disposed in the lower frame segment, elastically supported horizontally, is a locking latch for the frame. In this manner, installing the frame and performing its adjustment are rendered very simple.

The adjustment screws have a support surface for the frame and thereby control the height above the telescopic rail. The screw head of the adjustment screws is implemented such that a wedge of the locking latch can hook under it. During placement of the frame onto the adjustment screws, the locking latch is moved towards a spring and then snaps back in the locking position beneath the heads of the screws. The frame then rests on the support surfaces of the adjustment screws. By turning the adjustment screws, which are accessible in each case from above through a hole in the lower frame segment, in the thread in the lower telescopic rail, it is possible to adjust the height of the frame and its vertical tilt in a simple manner.

The locking latch is guided in the lower frame segment and is pushed toward the rear by the spring where it protrudes from the frame by approximately 2 cm. The limit stop is formed by the wedges that sit against the adjustment screws and that lock the frame in place. If forward pressure is now exerted onto the protruding end of the locking latch, the wedges release the adjustment screws and the frame can be lifted out. A limit stop that is located further toward the rear secures the locking latch in the disassembled condition.

Disposed on the upper telescopic rail are two bolts that serve for the lateral guiding of the frame. Disposed on the upper frame segment are a guide block and a snap lock. During the installation of the frame into the carcass, the bolts slide through the guide block and the front bolt is encompassed by the snap lock. The frame is now secured on the upper telescopic rail. Since the bolts are inserted into in the guide block and snap lock without being attached with respect to their height, the height tolerances between the telescopic rails and frame are compensated for.

The adjustment of the lateral position of the furniture front, as well as its alignment with the adjacent fronts is made possible by means of an upper and a lower adjustment strap with an adjustment block in each case. The adjustment straps are attached to the furniture front, the adjustment blocks to the front segment of the frame. The spacing between the adjustment block and the adjustment strap is adjusted by means of the adjustment screws, which push with their heads against the adjustment strap. An unequal adjustment of the adjustment screws may be used to also correct a horizontal angle. The horizontal position of the furniture front is adjusted by means of the elongated holes in the adjustment straps and by means of the fastening screws. The fastening screws connect the respective adjustment strap to the corresponding adjustment block and, hence, also the furniture front to the frame. The fastening screws, at the same time, also serve as counter screws for the adjustment screws.

The adjustment straps and adjustment blocks with the corresponding screws permit an adjustment in the horizontal position and compensation of angle errors.

The upper and lower adjustment strap are embedded flush in the front frame segment so that they form one plane with the frame segment toward the furniture front. The furniture front thus lies flat against the frame and the option presents itself to additionally secure the furniture front to the frame with screws after all adjusting processes have been completed. This provides additional stability and the pullout forces, e.g., of furniture handles on the furniture front, are transmitted better to the mounting hardware.

With the mounting hardware that is presented here, assembly of the tall-cabinet pullout is very simple. The furniture front and the frame are screwed to each other at working height, with the adjustment screws set to a normal adjustment. This combination is then placed onto the height adjustment screws on the lower telescopic rail. In the process, the locking latch locks the frame at the bottom to the telescopic rail. The upper telescopic rail is then pushed through the guide block and locked on the snap lock. This installation of the tall cabinet pull-put into the carcass of the cabinet is carried out without tools.

Adjusting of the furniture front in all degrees of freedom is possible in a very simple manner with the system that is described here. First, the height adjustment screws control the height and vertical tilt of the furniture front. The position of the furniture front regarding its depth is then controlled by means of the adjustment screws, and a possible incorrect horizontal position is corrected. The fastening screws control the lateral position of the furniture front and permit the adjustment of the vertical edges. The depth limit stop of the pullout is provided either through a stop notch in the telescopic rails or through the closing contact of the furniture front against the outer walls of the carcass.

A particular convenience results from the fact that the lower telescopic rail has integrated into it a buffer, which prevents a hard impact of the furniture front on the carcass when the tall-cabinet pullout is pushed in. If the telescopic rail is run on ball bearings, it also absorbs upwardly directed tilting forces. In this manner the buffer may be integrated at the bottom in the telescopic rail. The tappet of the buffer is extended by spring force and when the tall-cabinet pullout is pushed in, the tappet strikes a limit stop that is folded out in the form of a bracket from the lower metal support plate of the telescopic rail. In this manner the metal support plate fulfills two functions: fastening of the telescopic rail to the carcass and limit stop for the buffer.

The buffer can easily be retrofitted or replaced as it is only snapped in. The buffer is inserted into a holder and inserted together with this holder into the square tube between the two sides of the telescopic rail. Projecting into this square tube is a bolt that also serves as the nut for the height adjustment screw. An opened stop ring encompasses this bolt and the buffer is thereby fixed in the square tube. The square tube also serves as counter part for the limit stop and absorbs the forces from the buffer and its holder that occur when the pullout is pushed in. Since the bolt serves as a stop point and also as the nut for the height adjustment screws, it has multiple functions.

Regarding the buffer, different types may be used, for example gas pressure actuated springs or hydraulic shock absorbers. A particularly inexpensive type is a pneumatic buffer, whose tappet is re-extended by means of a reset spring.

BRIEF DESCRIPTION OF THE DRAWINGS

An embodiment of the mounting hardware is described in the figures by way of example.

DETAILED DESCRIPTION OF THE PREFERRED EMBODIMENT OF THE INVENTION

Figure 1:
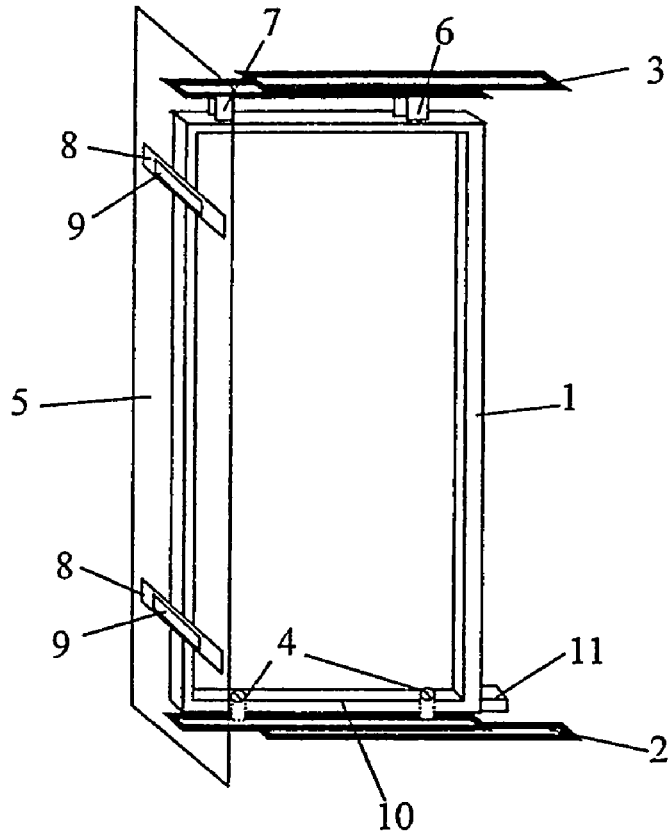
FIG. 1 shows a perspective rendering of the frame with the telescopic rails and furniture front

In FIG. 1 the frame 1 is shown in a perspective view with its attachment to the lower telescopic rail 2 and upper telescopic rail 3. The frame 1 rests on the height adjustment screws 4, which are screwed into the lower telescopic rail 2. The locking latch 11 protrudes from the frame 1 and can be pushed in for unlocking. The frame 1 is held at the top by means of the guide block 6 and snap lock 7.

The furniture front 5 is shown transparent. It is attached to the frame 1 by means of the adjustment straps 8 and adjustment blocks 9.

Figure 2:
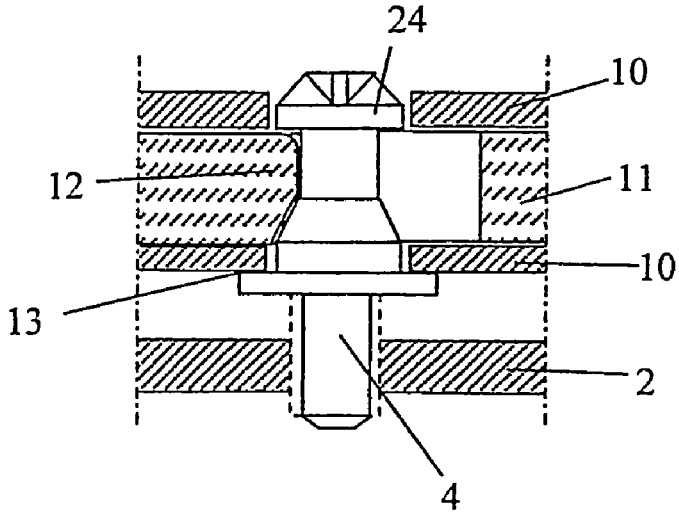
FIG. 2 shows a section through the frame with a height adjustment screw

FIG. 2 shows a section through the lower segment 10 of the frame 1 with one of two height adjustment screws 4 aligned with a screw hole of lower telescopic rail 2. The lower segment 10 of the frame 1 rests on the support surface 13. In this position, a spring biases the wedge 12 of locking latch 11 under the head 24 of the screws 4 and in this manner locks the frame in place between the rails (2) and (3). The screws 4 can then be adjusted in the lower telescopic rail 2 by turning the screws changing the distance between the telescopic rail 2 and lower frame segment 10.

Figure 3:
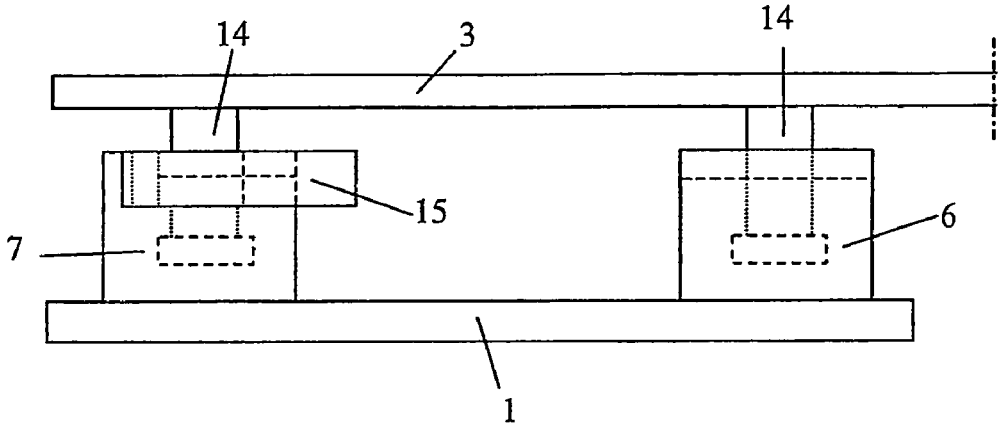
FIG. 3 is a schematic rendering of the guiding of the frame on the upper telescopic rail

In FIG. 3 it is illustrated schematically how the frame 1 is guided on the upper telescopic rail 3. The bolts 14 engage into the guide block 6 and snap lock 7. The snap lock 7 has a snap latch 15, which hooks around one bolt. The essential task of the upper telescopic rail 3 is the guiding in the lateral direction, which is accomplished by means of the bolts 14 and guide block 6 and snap lock 7. The bolts 14 are widened at their lower ends so that they cannot be pulled up out of the guide block 7 or snap lock 7.

Figure 4:
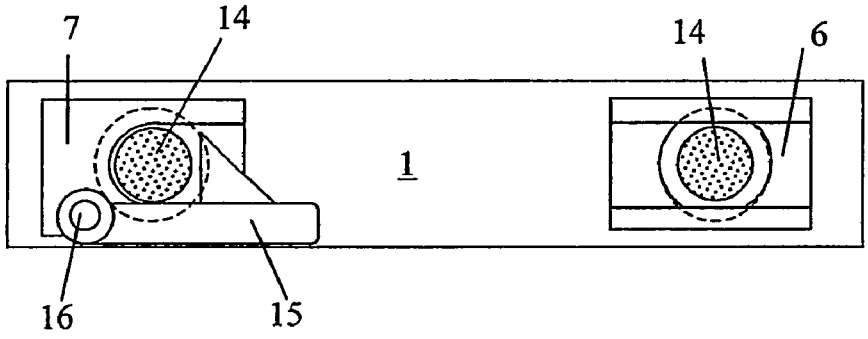
FIG. 4 is a top view of the upper guide blocks

FIG. 4 shows the upper guide means again, in a top view. During the assembly, the bolts 14 slide through the guide block 6. The front bolt 14 slides into the snap lock 7 and is encompassed by the snap latch 15. The snap latch 15 is elastically engaged by the bearing 16 in a manner so that it can turn. The rear bolt 14 is guided only laterally in the guide block 6.

Figure 5:
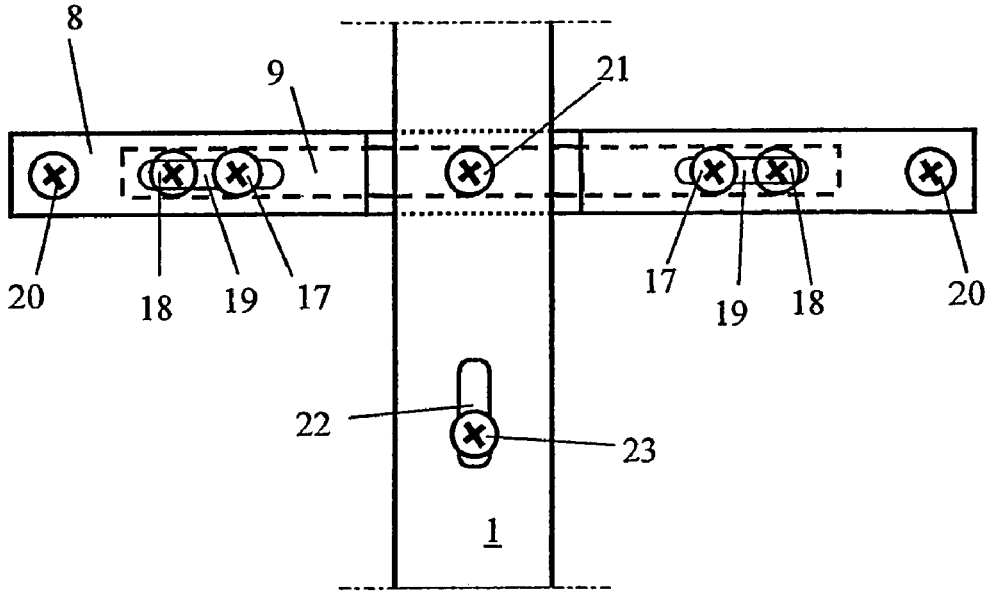
FIG. 5 shows the attachment of the furniture front

FIG. 5 shows the attachment of the furniture front (not shown here) on the frame 1. Attached to the frame 1 by means of the screw 21 is the adjustment block 9. The adjustment strap 8 is screwed with the screws 20 to the furniture front. Disposed on the adjustment block 9 are the adjustment screws 18 that control the spacing between the adjustment strap 8 and adjustment block 9 because the heads of the screws 18 push against the adjustment strap 8. The fastening screws 17 connect the adjustment strap 8 to the adjustment block 9. In doing so, they extend through the elongated holes 19. This permits the lateral shifting of the furniture front relative to the frame 1. Additionally provided in the frame 5 are elongated holes 22 through which the furniture front can additionally be fastened with screws 23.

Figure 6:
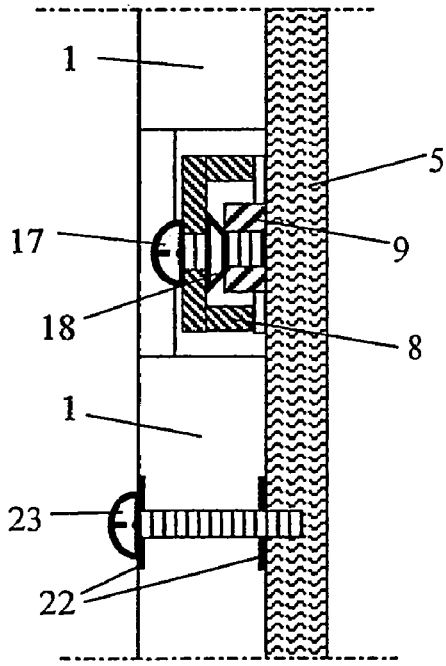
FIG. 6 shows a cross section through the attachment of the furniture front

FIG. 6 shows a section through the attachment of the furniture front 5 to the front frame segment 1. Disposed in the adjustment block 9, which is connected to the frame 1 by means of the screw 21 (not shown here), are the adjustment screws 18. Extending through the adjustment strap 8, which is attached to the furniture front 5, are the fastening screws 17. The furniture front 5 rests flat against the frame 1 and can thus additionally be fastened with the screws 23 through the elongated holes 22.

Figure 7:
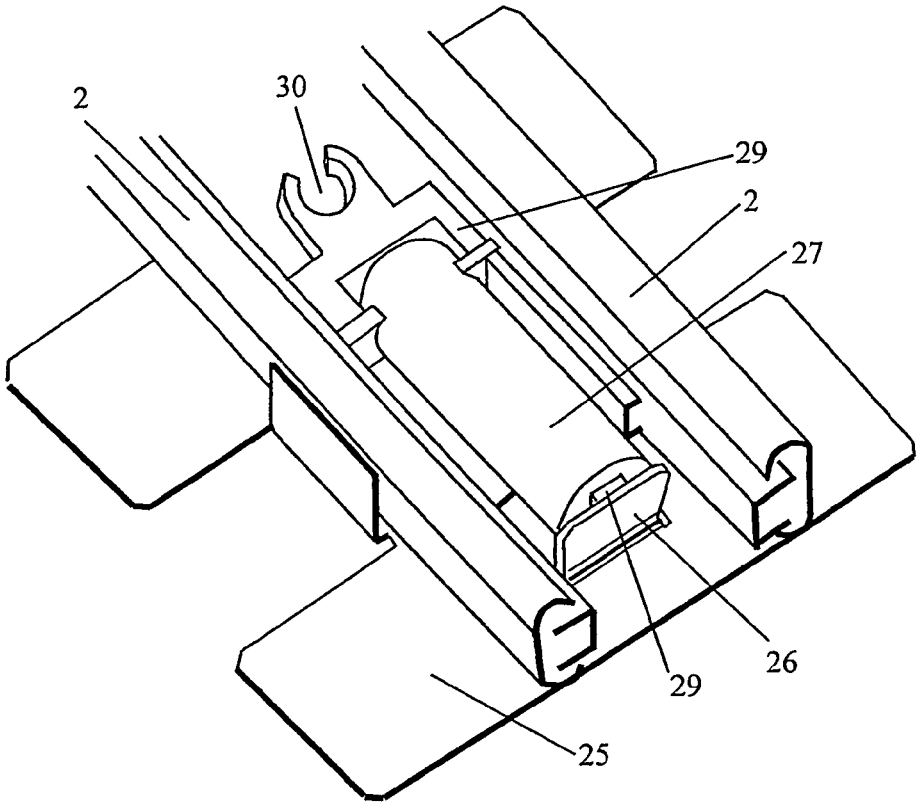
FIG. 7 shows a perspective view of the lower telescopic rail with buffer

FIG. 7 shows a perspective view of the back end of the lower telescopic rail 2. The two sides of the telescopic rail 2 are fixed on the metal support plate 25 by means of brackets. The limit stop 26, against which the tappet 28 can strike, is folded out perpendicularly from the metal support plate 25. The buffer 27 is held by the holder 29 which is inserted into the square tube, which is not shown here. The square tube connects the two insides of the telescopic rail. The open stop ring 30 encompasses the bolt 4, which is not shown here, which also serves as the counter support for the limit stop.

Figure 8:
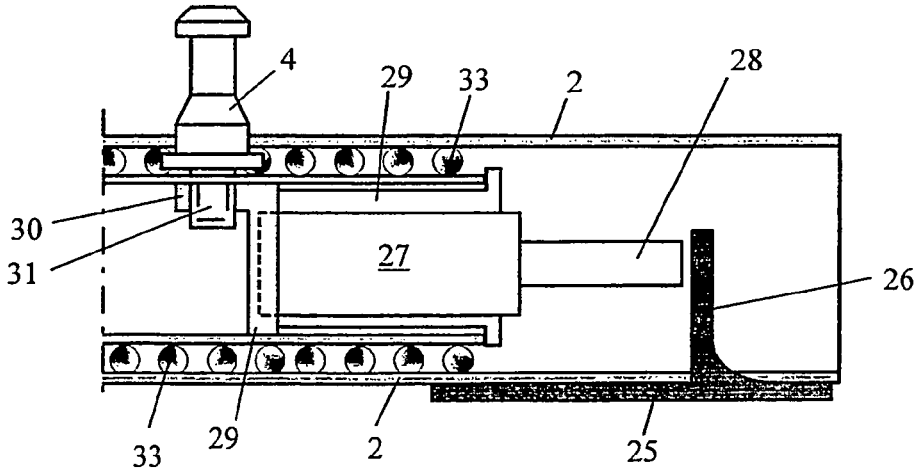
FIG. 8 shows a section through the lower telescopic rail with buffer.

In FIG. 8, a section through the lower telescopic rail 2 is shown. The two parts of the telescopic rail 2 are guided on the balls 33. The inside parts of the telescopic rail are connected to each other by means of the square tube 32. Also attached to the square tube is the bolt 31, which also serves as the nut for the height adjustment screw 4. The holder 29 is inserted into the square tube 32 and carries the buffer 27. Its tappet 28 strikes the limit s top 26, which is erected from the metal support plate 25. The bolt 31 is encompassed by the open stop ring 30 of the holder 29 and secures the buffer. The additional enlargement on the holder 29 abuts the end of the square tube 32 and, in this manner, forms a counter support for the impact onto the limit stop 26.

LIST OF REFERENCE NUMERALS

1 frame
2 lower telescopic rail
3 upper telescopic rail
4 height adjustment screw
5 furniture front
6 guide block
7 snap lock
8 adjustment strap
9 adjustment block
10 lower frame segment
11 locking latch
12 wedge
13 support surface
14 bolt
15 snap latch
16 latch bearing
17 fastening screws
18 adjustment screws
19 elongated holes
20 screws
21 screw
22 elongated holes
23 screw
24 screw head
25 metal support plate
26 limit stop
27 buffer
28 tappet
29 holder for the buffer
30 stop ring
31 bolt for buffer
32 square tube
33 balls

What is claimed is:

1. Mounting hardware for a tall-cabinet pullout, comprising:

an upper rail and a lower rail;

a rigid frame having an upper segment attached to said upper rail and a lower segment attached to said lower rail;

a furniture front affixed to said rigid frame;

a plurality of height-adjustment screws disposed at a spacing distance from one another along said lower rail, said height-adjustment screws locking said lower segment of said rigid frame to said lower rail; and setting a spacing distance between said lower segment of said rigid frame and said lower rail for vertically setting a position of said rigid frame between said upper rail and said lower rail;

wherein turning of said height adjustment screws causes a vertical adjustment of said rigid frame between said upper and lower rails without unlocking an attachment between said lower segment of said rigid frame and said lower rail; and a locking latch for locking said lower segment of said rigid frame to said lower rail, said locking latch having a locked position wherein said locking latch is spring-biased and slidably engaged against said screws in said lower frame segment; and a spring supported in said lower frame segment and wherein the locking latch in said lower frame segment is formed sufficiently long so as to be biased by said spring to protrude in the locked position out from said lower frame segment and be pushed against said spring that is supported in said lower frame segment to unlock said rigid frame from between the upper and lower rails.

2. The mounting hardware according to claim 1, wherein said height adjustment screws are two screws screwed into said lower rail, wherein each of said screws has a head extending through a bottom of said lower frame segment, and each of said screws has a support surface engaging under the bottom of said lower frame segment, and wherein said spring biased locking latch engages into a recess between each said head (24) and said support surface of said screws when said locking latch is in the locked position.

3. The mounting hardware according to claim 1, wherein:

a first bolt and a second bolt are affixed to said upper rail, and a snap lock and a guide block are affixed to said upper segment of said rigid frame; and said first bolt is engaged in said snap lock and said second bolt is engaged in said guide block when said rigid frame is engaged to said upper rail.

4. The mounting hardware according to claim 1, wherein said furniture front is fixed on a front segment of said frame by two vertically spaced adjustment straps that are affixed horizontally on said furniture front, each adjustment strap having a recess, an adjustment block being located in each said recess, each said adjustment block being screwed to said frame.

5. The mounting hardware according to claim 4, wherein elongated holes are formed in each adjustment strap to permit horizontal adjustment and vertical positioning of lateral edges of said furniture front by fastening screws.

6. The mounting hardware according to claim 5, wherein the fastening screws are screwed into the adjustment blocks, wherein a space between each adjustment strap and each adjustment block is adjusted by changing the height of the heads of adjustment screws, said adjustment screws being disposed in said adjustment block and pushing against said adjustment strap.

7. The mounting hardware according to claim 6, wherein said furniture front is additionally attached by means of screws in elongated holes formed in said frame.

8. The mounting hardware according to claim 1, wherein said lower rail comprises a movable part, a stationary part, a buffer connected to said movable part said buffer engaging with a limit stop formed on a metal support plate mounted on said stationary part.

9. The mounting hardware according to claim 8, wherein said buffer is engaged into said lower rail by way of a holder having an open stop ring engaging a bolt.

10. The mounting hardware according to claim 9, wherein said bolt is formed by a portion of one of said height adjustment screws.

11. The mounting hardware according to claim 8, wherein the limit stop for the buffer is a tab formed at an angle to the rear metal support plate.

12. The mounting hardware according to claim 8, wherein said buffer is a pneumatic buffer with a reset spring.

* * * * *